United States Patent [19]

Moore

[11] Patent Number: 4,569,754

[45] Date of Patent: Feb. 11, 1986

[54] SELECTIVE VAPORIZATION PROCESS

[75] Inventor: Andrew S. Moore, North Brunswick, N.J.

[73] Assignee: Engelhard Corporation, Menlo Park, N.J.

[21] Appl. No.: 681,468

[22] Filed: Dec. 14, 1984

[51] Int. Cl.[4] ..... C10G 25/09

[52] U.S. Cl. ..... 208/91; 208/127; 208/251 R; 208/262; 502/54; 502/515; 502/516

[58] Field of Search ..... 208/91, 85, 127, 128, 208/251 R, 262, 521 T; 502/54, 514, 515, 520

[56] References Cited

U.S. PATENT DOCUMENTS

| | | | |
|---|---|---|---|
| 2,935,464 | 5/1960 | Dudley et al. | 208/85 |
| 3,121,695 | 2/1964 | Stringer et al. | 502/54 |
| 3,284,344 | 11/1966 | Demeester et al. | 208/262 |
| 4,263,128 | 4/1981 | Bartholic | 208/93 |
| 4,309,274 | 1/1982 | Bartholic | 208/91 |
| 4,311,580 | 1/1982 | Bartholic | 208/91 |
| 4,325,809 | 4/1982 | Bartholic | 208/91 |
| 4,328,091 | 5/1982 | Bartholic | 208/91 |
| 4,374,021 | 2/1983 | Bartholic | 208/91 |
| 4,384,949 | 5/1983 | Reagan et al. | 208/91 |
| 4,424,118 | 1/1984 | Rankel | 208/251 R |
| 4,427,538 | 1/1984 | Bartholic | 208/251 R |
| 4,446,009 | 5/1984 | Bartholic | 208/251 R |

FOREIGN PATENT DOCUMENTS 0077044 8/1982 European Pat. Off. .

*Primary Examiner*—John Doll
*Assistant Examiner*—Anthony McFarlane
*Attorney, Agent, or Firm*—Inez L. Moselle

[57] ABSTRACT

Coke or coke and hydrogen production may increase when the Asphalt Residual Treating (ART) Process for removing metallic and carbonaceous contaminants from hydrocarbons is operated with feed stock containing impurities that result in the deposition on the solid particulate contact material of acidic metallic compounds such as heavy metal chlorides. Coke or coke and hydrogen production is reduced by charging ammonia or other fugitive basic nitrogen compounds to the system after burning coke from the circulating inventory of catalytically inert contact material and prior to selectively vaporizing incoming charge of feed stock in the presence of the hot regenerated contact material.

17 Claims, 2 Drawing Figures

SELECTIVE VAPORIZATION PROCESS

BACKGROUND OF THE INVENTION

This invention relates to improvements in the Asphalt Residual Treating (ART TM) Process for upgrading hydrocarbon feedstocks contaminated with heavy metals. In particular, the invention relates to improving operation of ART units when the feedstock becomes contaminated with or is likely to become contaminated with halogens such as sodium chloride, resulting in an increase in coke or coke and hydrogen production in excess of levels anticipated on the basis of removal of Conradson Carbon in the feedstock and metals content of the contact material.

The Asphalt Residual Treating (ART) Process is a decarbonizing and demetallization process that has been developed to treat residual stocks and heavy crudes for the removal of contaminants. The process is described in numerous publications, including "The ART Process Offers Increased Refinery Flexibility", R. P. Haseltine et al, presented at the 1983 NPRA Conference in San Francisco. See also U.S. Pat. No. 4,263,128 to Bartholic. The process is a non-catalytic technological innovation in contaminant removal and will typically remove over 95% of the metals, essentially all the asphaltenes and 30% to 50% of the sulfur and nitrogen from residual oil while preserving the hydrogen content of the feedstock. This provides greatly improved cost-effectiveness by producing less unwanted by-products and consuming less energy than competing processes. The ART Process also enables the subsequent conversion step in residual oil processing to be accomplished in conventional downstream catalytic processing units.

The ART Process utilizes a fluidizable solid particulate contact material which selectively vaporizes the valuable, lower molecular weight and high hydrogen content components of the feed. The contact material is substantially catalytically inert and little if any catalytic cracking occurs when the process is carried out under selected conditions of temperature, time and partial pressure. Generally, suitable contact material has a relatively low surface area, e.g., 5 to 20 $m^2/g$ as measured by the BET method using nitrogen. Heavy metals are deposited on the contact material and removed. High molecular weight asphaltenes also deposit on the contact material, some asphaltenes being converted to lighter products.

The ART process is adapted to be carried out in a continuous heat-balanced manner in a unit consisting primarily of a contactor, a burner and an inventory of recirculating contact material. Chargestock is contacted with particles of hot fluidizable contact material for a short residence time in the contactor. In the contactor, the lighter components of the feed are vaporized; asphaltenes and the high molecular weight compounds, which contain metals, sulfur and nitrogen contaminants, are deposited on the particles of the contact material. The metals invariably include vanadium and nickel. Some of the asphaltenes and high molecular weight compounds are thermally cracked to yield lighter compounds and coke. The metals that are present, as well as some of the sulfur and nitrogen bound in the unvaporized compounds, are retained on particles of contact material. At the exit of the contacting zone, the oil vapors are rapidly separated from the contact material and then immediately quenched to minimize incipient thermal cracking of the products. The particles of contact material, which now contain deposits of metals, sulfur, nitrogen, and carbonaceous material are transferred to the burner where combustible contaminents are oxidized and removed. Regenerated contact material, bearing metals but minimal coke, exits the burner and circulates to the contactor for further removal of contaminants from the charge stock.

In practice, the metals level of contact material in the system is controlled by the addition of fresh contact material and the removal of spent contact material. A high metals level can normally be maintained without detrimentally affecting performance.

Because the contact material is essentially catalytically inert, very little molecular conversion of the light gas oil and lighter fractions takes place. Therefore the hydrogen content of these streams is preserved. In other words, the lighter compounds are selectively vaporized. The molecular conversion which does take place is due to the disproportionation of the heavier, thermo-unstable compounds present in the residual feedstock.

The hydrogen content of the coke deposited on the contact material is typically less than four percent. Coke production is optimally equivalent to 80% of the feedstock Conradson Carbon Residue content. Heat from the combustion of coke is used internally within the ART system. Surplus heat may be recovered as steam or electric power. No coke product is produced. In contrast, delayed and fluid cokers yield a coke product equivalent to 1.3 to 1.7 times the Conradson Carbon residue.

Generally, metals accumulated on the contact material used in the ART process tend to be less active in forming coke than metals accumulated on cracking catalyst. Thus, the ART process is able to operate effectively when accumulated metals are present on the contact material at levels higher than those which are generally tolerable in the operation of FCC units. For example, the process has operated effectively when combined nickel and vanadium content substantially exceeded 2% based on the weight of the contact material. However, during operation of one particular ART unit, coke production began to increase to levels that were considerably higher than would be expected based on the Conradson Carbon content of the feed and metals content of the contact material. Hydrogen production also increased. In other words, it appeared that metals deposited on the circulating inventory of contact material had become activated. In the operation of FCC units, a similar excursion from normal operation may be experienced but, generally, at lower metals levels.

SUMMARY OF THE INVENTION

Detailed Description

In accordance with embodiments of the present invention, the ability of metals accumulated on particles of the sorbent contact material used in an ART unit to produce coke or coke and hydrogen during the selective vaporization treatment in an ART contactor is reduced by injecting at least one fugitive basic nitrogen-containing material (or a source thereof), preferably ammonia, ammonium polysulfide or combinations thereof, into the feedstock or, most preferably into contact with hot regenerated particles of sorbent contact material before the sorbent particles contact incoming petroleum feedstock.

The invention is of special utility when there is an excursion in operation of an ART unit such that metals accumulated on the sorbent contact material result in an unexpected increase in coke or coke and hydrogen and feedstock is contaminated with a source of halide ions, such as chloride ions. The invention is also useful in insuring against such increase in coke or coke and hydrogen before the increase occurs by introducing the basic nitrogen compound into the ART process cycle; in the event that halide contamination does occur, coke or coke and hydrogen increase is minimized or will not occur. An upset in a feedstock desalter is a usual source of chloride contaminated feedstock. Contamination of feedstock with a halogenated solvent such as ethylene chloride may also give rise to the problem. It is postulated that the halide ions will react with metals accumulated on the sorbent contact particles to form metallic halides which are acidic and that the sorbent particles, now bearing acidic halides, undesirably function to crack feedstock and produce coke or coke and hydrogen in excess of the amount of coke attributable to the metals and Conradson Carbon. It is believed that the basic nitrogen compound, e.g., ammonia, neutralizes acidic metallic halides, thereby destroying potential sites of undesirable cracking activity. By introducing a source of basic nitrogen material into an inventory of particles of contact material circulating from the ART burner before the point of injecting fresh feed, acidic cracking sites arising from metal halides on the particles will be neutralized and increments of coke production attributable to acid sites will thereby be avoided. It is believed that introduction of the basic nitrogen material into feedstock prior to contact of feedstocks with circulating contact material will also reduce the activity of accumulated metal chlorides to form coke. In either case, halides can react with the nitrogen base to form halide salts which are decomposed in the ART contactor into volatile components. For example, when ammonia, ammonium polysulfide (or a combination thereof) is employed and the halide is in the form of a chloride, one or more ammonium chloride salts may form in the contactor. In effect, ammonia will function to remove the halide which, if present, would impart acidity to the accumulated metal(s). The resulting salts will be dissolved in water and thus can be removed with water that is withdrawn from the system.

One aspect of the invention comprises a process for preparing premium products from a charge of petroleum hydrocarbon feedstock having a substantial Conradson Carbon number and metals content which comprises contacting the feedstock in a decarbonizing and demetallizing zone with particles of a fluidizable solid contact material having a low microactivity for catalytic cracking, at low severity, including a temperature of at least 900° F., for a period of time less than that which induces substantial thermal cracking of the feedstock; at the end of such period of time separating from solid the vaporized major fraction of the feedstock a decarbonized volatilized hydrocarbon fraction of reduced Conradson Carbon number and metals content as compared with the feedstock; reducing temperature of the separated fraction to a level below that at which substantial thermal cracking takes place; subjecting said particles of fluidizable inert solid after contact with said feedstock to air at elevated temperature in a separate burning zone to remove combustible deposit from said solid and heat the solid; recycling at least a portion of said particles of fluidizable solid from the burning zone to the decarbonizing zone for further decarbonizing and demetallization of the feedstock; and, at least when the feedstock is likely to become contaminated with a halogen contacting at least a portion of said fluidizable solid particles so recycled to the decarbonizing zone with a volatile basic nitrogen compound or a compound thermally decomposable thereto in said contactor, either prior to or simultaneously while contacting said particles with feedstock in the decarbonizing zone.

Another aspect of the invention comprises a process for preparing premium products from petroleum having a substantial content of Conradson Carbon and metals which is contaminated with a halogen compound, such as sodium chloride, which comprises (a) contacting the petroleum hydrocarbon feedstock in a rising confined vertical column with fluidizable particles which are catalytically inert or substantially so for a contact time such as to avoid substantial thermal cracking of the feedstock and selectivity vaporize hydrocarbons and deposit hydrocarbons contributing to Conradson Carbon number as well as metals and chloride salt on said fluidizable particles; (b) at the end of such period of time separating from said particles of inert material now having a deposit of hydrocarbon, metals and salt from a vaporized decarbonized hydrocarbon fraction of reduced Conradson Carbon number as compared with the residual fraction; (c) reducing temperature of the separated hydrocarbon fraction to a level below that at which substantial thermal cracking takes place; (d) fractionating the vaporized decarbonized hydrocarbon fraction; (e) adding liquid water to at least a portion of the lighter hydrocarbons such as gases and naphtha from step (d) and separating the water from hydrocarbon; (e) burning combustibles from the particles of inert material to remove the combustible deposit and thereby heat the inert solid; (f) separating hot gases from the burning of combustibles from hot inert solids in the burner; (g) recycling at least a portion of the hot inert solids into contact with further charge of hydrocarbon feedstock; (h) injecting ammonia or a source of ammonia into contact with said recycled hot solids prior to step (g) in amount corresponding to at least the stoichiometric equivalent amount of halogen in the further charge of hydrocarbon feedstock; (i) reacting ammonia with halogen in the contacting zone, whereby a volatile material containing ammonia and halide is carried into the vaporized hydrocarbon fractions in step (b) and reports in the liquid water that is separated from hydrocarbon in step (e); and, optionally injecting additional ammonia or source of ammonia into further charge of feedstock.

Figure 2:
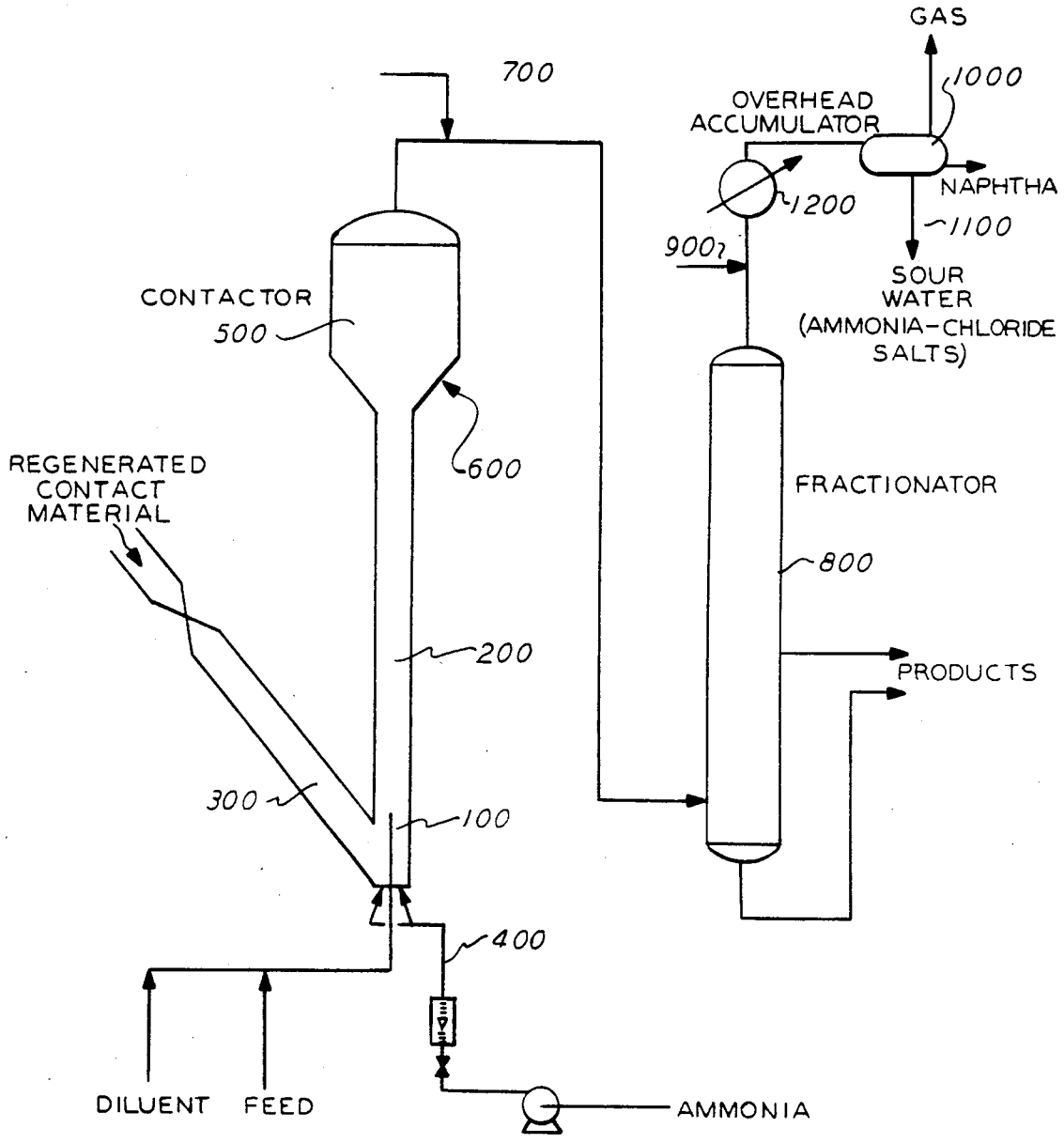

In the embodiment of the invention shown in FIG. 2, which represents the presently envisioned best mode of practicing the present invention, the contact material from the burner is treated with a source of ammonia before being recycled to the contactor, and water is injected into the gas and naphtha product vapor upstream of the fractionator overhead cooler. Ammonium salts report in the resulting sour water that is subsequently withdrawn from the system.

Figure 1:
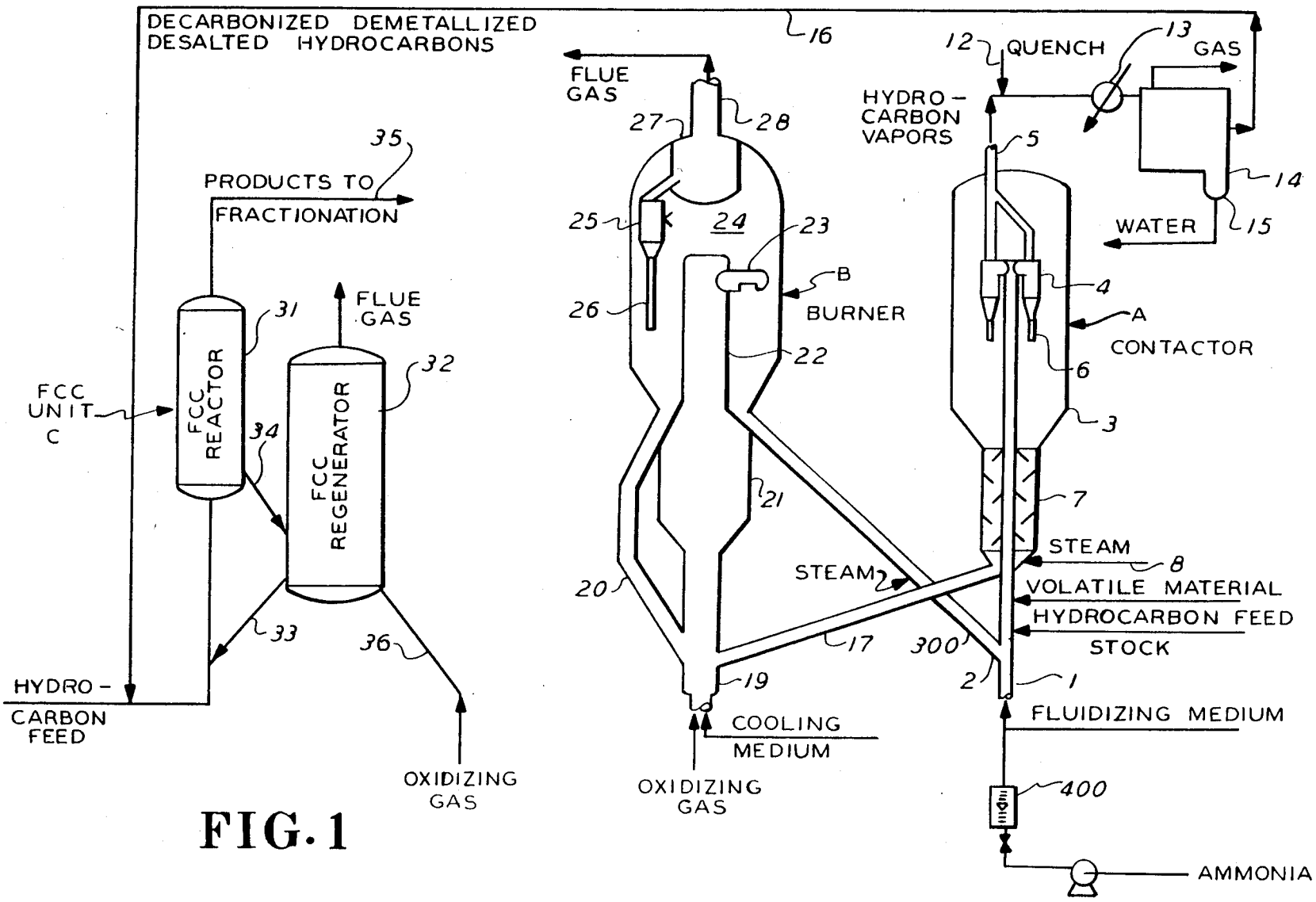
FIG. 1 is a schematic flow chart of the process for pretreating a hydrocarbon feedstock by selective vaporization with inert fluidizable solid particles, including treatment with a source of ammonia, and then charging the pretreated feedstock to an FCC process.

Shown in FIG. 1 are means for carrying out a pretreatment process for decarbonizing, demetallizing and/or desalting a hydrocarbon feedstock, such as a whole crude or a resid. The means for carrying out the pretreatment process include a contactor A, for carrying out a selective vaporization step and a burner B, for carrying out a combustion step.

In the selective vaporization step, the hydrocarbon feedstock is mixed in a confined rising vertical column or riser 1 in the contactor A, shown in FIG. 1, with solid fluidizable contact material that is catalytically inert or substantially so. The contact material is supplied to the riser, heated to a high temperature.

During the selective vaporization step, hydrocarbons in the feedstock are vaporized by the high temperature contact with the contact material in the riser 1 of contactor A. There is also sorption of the high Conradson Carbon components, metal-containing components (particularly those containing nickel and vanadium) and salts (e.g., sodium salts) originating in the feedstock and deposited on the contact material.

At the top of the riser 1, after vaporization of most of the hydrocarbons in the feedstock and sorption of its high Conradson Carbon and metal-containing components and salts by the contact material, the vaporous hydrocarbons are rapidly separated from the contact material. Then the hydrocarbon vapors are quenched as rapidly as possible to a temperature at which thermal cracking is essentially arrested.

The selective vaporization step involves very rapid vaporization and very short residence time of the hydrocarbon feedstock in the riser 1. This minimizes thermal cracking of the feedstock. The conventional method for calculating residence time in superficially similar FCC riser reactors is not well suited to the selective vaporization step. FCC residence times assume a large increase in number of mols of vapor as cracking proceeds up the length of the riser. Such effects are minimal in the selective vaporization step. Hence, for the selective vaporization step, hydrocarbon residence time (i.e., the time of contact between the feedstock and the contact material) is calculated as the length of the riser from the point where the feedstock and the contact material is separated from the hydrocarbon vapors (i.e., at the top of the riser), divided by the superficial linear velocity at the separation point. As so measured the hydrocarbon residence time for the selective vaporization step should be less than 3 seconds. Since some minor thermal cracking of the portions of the feedstock, deposited on the contact material, particularly the high Conradson Carbon and metal-containing components of the feedstock, will take place at the preferred selective vaporization temperatures, the selective vaporization step can be improved by reducing as much as possible the hydrocarbon residence time. Thus a hydrocarbon residence time of less than 2 seconds is preferred, especially 0.5 second or less. The hydrocarbon residence time should, however, be long enough to provide adequate intimate contact between the feedstock and the contact material (e.g., at least 0.1 second).

As shown in FIG. 1, the contact material is introduced into the riser 1 at or near the bottom of the riser, preferably with a fluidizing medium, such as steam, water or light hydrocarbon. The fluidizing medium transports the contact material up the riser 1 as the contact material heats the fluidizing medium. The feedstock is introduced at a point along the riser 1 which will insure a proper hydrocarbon residence time. Preferably, a volatile material, such as steam, water or a hydrocarbon, is added to, and mixed with, the feedstock.

The feedstock can be preheated before it is introduced into the riser 1 to any temperature below thermal cracking temperatures, e.g., 200°-800° F., preferably 300°-700° F. Preheating temperatures higher than about 800° F. can induce thermal cracking of the feedstock with undesirable production of low octane naphtha.

The contact material is introduced into the riser 1 at a high temperature. Temperature of the contact material introduced into the riser is such that the resulting mixture of contact material and feedstock is at an elevated contact temperature which is upwards of 700° F. (up to about 1050° F.), preferably about 900°-1000° F. In this regard, the contact temperature of the mixture of feedstock and contact material should be high enough to vaporize most of the feedstock and its diluents (i.e., the fluidizing medium and the volatile material, if used). For a resid feedstock boiling above about 500°-650° F., a contact temperature of at least 900° F. will generally be sufficient. For a feedstock containing light ends, such as a whole crude or a topped crude, the contact temperature should be above the average boiling point of the feedstock as defined by Bland and Davidson, "Petroleum Processing Handbook"—that is, at a temperature above the sum of ASTM distillation temperatures from the 10 percent point to the 90 percent point, inclusive, divided by 9.

The pressure in contactor A should, of course, be sufficient to overcome any pressure drops in the downstream equipment. In this regard, a pressure of 15-50 psi in the contactor A is generally sufficient.

During the very brief, high temperature contact of the contact material with the feedstock in the selective vaporization step, the majority of the heavy components of the feedstock having high Conradson Carbon residues and/or metal content and salts in the feedstock is deposited on the contact material. This deposition may be a coalescing of liquid droplets, adsorption, condensation or some combination of these mechanisms on the particles of the contact material. In any event, there appears to be little or no conversion of a chemical nature. Particularly, thermal cracking is minimal and is primarily restricted to the portions of the feedstock deposited on the contact material. What is removed from the feedstock by the contact material under preferred conditions is very nearly that indicated by the Conradson Carbon of the feedstock. Further, the hydrogen content of the deposits on the contact material is about 3-6%, below the 7-8% normal in FCC coke.

The hot contact material and any fluidizing medium, introduced at the bottom of the riser 1 of contactor A, move upwardly in the riser at high velocity, e.g., 40 feet per second or more as measured at the top of the riser. The hot contact material mixes rapidly with the feedstock and any volatile material in the riser and carries the feedstock and volatile material up the riser at high velocity. The feed rate and temperature of the hot contact material, as well as the fluidizing medium and the volatile material, are such in the riser that the resulting mixture is at a suitable elevated temperature to volatilize all or most of the components of the feedstock except the majority of its high Conradson Carbon and metal-containing compounds and its salts.

At the top of the riser 1 in the contactor A, the vaporized hydrocarbons are separated as rapidly as possible from the entrained contact material on which the high Conradson Carbon and metal-containing components, as well as any salts of the hydrocarbon feedstock, are deposited. This can be accomplished by discharging the hydrocarbon vapors and the contact material from the riser 1 into a large disengaging zone defined by vessel 3. However, it is preferred that the riser discharge directly into cyclone separators 4. As is well known in the FCC art, a plurality of cyclones 4 can be utilized. From the cyclones 4, hydrocarbon vapors are transferred to a vapor line 5, and contact material drops into the disengaging zone of vessel 3 by diplegs 6 and from there drops to stripper 7. In stripper 7, steam, admitted by line 8, displaces traces of volatile hydrocarbons from the contact material.

The hydrocarbon vapors from vapor line 5 of the contactor A are mixed with cold liquid hydrocarbons introduced by line 12 to arrest thermal cracking. The so-quenched hydrocarbons are then cooled in condenser 13 and passed to accumulator 14 from which gases are removed for further processing or for fuel. Condenser 13 can be suitably utilized as a heat exchanger to preheat the decarbonized, demetallized, and/or desalted hydrocarbons that are in accumulator 14.

Certain advantages can be realized in the pretreatment process, shown in FIG. 1, when fluidizing medium is introduced into the riser 1 of the contactor A by using recycled hydrocarbons (e.g., hydrocarbons obtained by fractionating the hydrocarbon vapors from the contactor A in the column quencher, mentioned above) instead of recycled water (e.g., water from sump 15) or steam as the volatile material, introduced into riser 1. Using water or steam as the volatile material requires that the effluent of hydrocarbon vapors from the contactor A be cooled to the point of condensation of water, which in this water vapor/hydrocarbon vapor system is about 150° F. This results in relatively high losses in the valuable sensible heat and heat of condensation of the hydrocarbon vapors. When, however, recycled hydrocarbons are used as the volatile material, condensation of the effluent from the top of the riser can be accomplished at higher temperatures, resulting in much lower losses in the sensible heat and heat of condensation of the hydrocarbon vapors.

The liquid hydrocarbons in accumulator 14 are desalted, decarbonized and demetallized hydrocarbons, such as a resid, and comprise a satisfactory charge for an FCC process or for a hydroprocess. Preferably, part of the liquid hydrocarbons in accumulator 14 is used as the cold quench liquid in line 12, and the balance is transferred directly to the FCC unit C by line 16.

As shown in FIG. 1, the contact material bearing combustible deposits of high Conradson Carbon compounds and metal-containing compounds from the hydrocarbon feedstock passes from the stripper 7 in the Contactor A by a standpipe 17 to the inlet 19 at the bottom of the Burner B, used in the combustion step of the pretreatment process. The process is preferably operated in the heat balanced mode. This is accomplished by a valve in regenerated catalyst standpipe that is controlled responsive to temperature in the selective vaporization zone. In the burner B, the contact material contacts an oxidizing gas, such as air or oxygen, preferably air. The combustion step can be carried out in the burner B using, for example, any of the techniques suited to the regeneration of an FCC catalyst. Temperature in the dense phase of the burner is above about 1100° F., most usually in the range of about 1200° F. to 1500° F. Temperatures appreciably above 1500° F., for example temperatures as high as 2000° F., may be used provided the burner and its internals are constructed of materials capable of withstanding such temperatures.

Combustion of the combustible deposits on the contact material to carbon monoxide, carbon dioxide or water vapor or to carbon dioxide and water vapor generates the heat required for the selective vaporization step when heated contact material is returned by the standpipe 2 to the riser 1 in the contactor A and is mixed with hydrocarbon feedstock, fluidizing medium and volatile material. Combustion of nitrogen and sulfur in the combustible deposit to oxides of sulfur and nitrogen also takes place.

The burner B can be similar in construction and operation to any of the known FCC regenerators. The burner can be of the riser type with hot recycle as shown in FIG. 1 or can be of the older, dense fluidized bed type. The burner can include any of the known expedients for adjusting burner temperature, such as nozzles for burning torch oil in the burner to raise temperature or heat exchangers to reduce temperature.

As shown in FIG. 1, contact material, with its combustible deposits, passes from the stripper 7 of the contactor A to the burner inlet 19 via standpipe 17. At the burner inlet 19, the contact material from standpipe 17 meets, and mixes with, a rising column of an oxidizing gas, preferably air, introduced into the burner inlet 19. If desired, contact material may meet and mix with steam or water, introduced into the burner inlet 19.

At the burner inlet 19, the contact material from standpipe 17 also meets and mixes with hot contact material from burner recycle 20. The hot recycled contact material rapidly heats the fresh contact material to the 1100°-1500° F. temperature required for combustion of the deposits on the contact material.

The mixture of fresh and recycled contact materials is carried upwardly from the burner inlet 19 to an enlarged zone 21 in the burner where the contact material forms a small fluidized bed in which thorough mixing and initial burning of the combustible deposits on the fresh contact material occur. The burning mass of contact material passes through a restricted riser 22 to discharge at 23 into an enlarged disengaging zone 24. The hot burned particles of contact material fall to the bottom of the disengaging zone 24. A part of the hot contact material enters recycle 20; another part enters the standpipe 2 for recycle to the riser after steam stripping. Another part is periodically withdrawn to maintain the activity of the contact material at a desired low level. This material may be discarded or treated for removal of metals and then recycled through A and B.

After the pretreatment of the hydrocarbon feedstock, the resulting decarbonized, desalted and demetallized hydrocarbons comprise a good quality feedstock for the FCC unit, indicated at C in FIG. 1. Hence, as shown in the figure, the hydrocarbons are transferred from the accumulator 14 by line 16 to an FCC reactor 31 which may be operated in a conventional manner. Hot regenerated catalyst is transferred from an FCC regenerator 32 by a standpipe 33 for addition to the reactor charge. Partially spent catalyst from FCC reactor 31 passes by a standpipe 34 to the regenerator 32, while cracked products leave reactor 31 by transfer line 35 to fractionation for recovery of gasoline and other products.

As shown in FIG. 1, ammonia is pumped through meter 400 through feed distributor 1 into contact with fluidizing medium, feedstock and regenerated contact material charged through line 300. Water is introduced at 900 to quenched hydrocarbon vapors which include ammonia originally introduced through meter 400 and chloride introduced with hydrocarbon feedstock. Ammonium salts are eventually removed from sump 15. Further details are shown in FIG. 2.

FIG. 2 illustrates a presently preferred embodiment in which added ammonia is removed as a chloride salt in water used in conventional manner to prevent salts from depositing on cooling surfaces and is added to hydrocarbon from a fractionation vessel to which the charge is the lower boiling vaporized product from contactor A. As shown in FIG. 2, the hydrocarbon feed and any diluent that may be associated with the feed enters the contactor riser 200 through a feed distributor 100 that provides intimate mixing of the feed/diluent mixture and a recycled hot inert contact material stream charged through line 300. Prior to mixing with the feed diluent mixture, an ammonia containing compound is pumped through meter 400 injected into the hot inert contact material stream at 100. The ammonia compound removes acidic contaminants from the contact material by forming ammonium salts. After removing much of the metal, carbon residue, asphaltene, sulfur, nitrogen, and acidic contaminants from the hydrocarbon feed, the product vapors are separated from the inert contact material in the contactor 500. A portion of the entrained hydrocarbon product is removed from the contact material by the use of a stripper gas or vapor 600. Any combustible material deposited on the inert contact material is burned in a separate vessel (not shown in FIG. 2) and recycled back to the base of the contactor riser 200. After separation from the contact material, the product vapors are quenched at 700 in order to inhibit thermal degradation of the product vapors. The quenched product vapors are directed into a fractionation vessel 800 which may be of conventional design. The product vapors are separated according to their boiling range in the fractionation vessel. A wash water stream (900) is injected into the gas and naphtha product vapor upstream of the fractionator overhead cooler (1200). The dissolved salts, product gas and naphtha are separated into an aqueous phase, liquid hydrocarbon phase, and a vapor phase in the overhead accumulator 1000. The aqueous phase containing the dissolved salts composed of ammonia and acidic contaminants is then drained from the accumulator by a line 1100.

During normal operations, the amount of ammonia injected into the stream of contact material is related to the amount of chloride ions present in the feed stream. The ammonia to chloride ratio must be at least the stoichiometric ratio. In the event of a severe upset, the ammonia injection rate should be adjusted to at least twice the stoichiometric ratio of ammonia to chloride ions on the regenerated contact material. It is within the scope of the invention to add a source of ammonia substantially in excess of a stoichiometric amount since unreacted ammonia will be withdrawn in wash water. Addition of large quantities of a source of ammonia to feed being processed in an FCC riser would be undesirable because the ammonia would neutralize cracking sites in the FCC catalyst. Consequently, activity of the catalyst would be decreased. The process of the invention utilizes as contact material particles that are substantially inert to the cracking of petroleum hydrocarbons. Therefore, the presence of unneutralized ammonia in the vaporization zone will not be deleterious as it would be in the operation of an FCC unit.

The solid contacting agent used in the process is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27° API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. A procedure for making microspheres of calcined kaolin is described in U.S. Pat. No. 4,263,128 at col. 4, 1. 62 to col. 6, 1. 13, which disclosure is incorporated herein by cross-reference.

The following example is given to more fully illustrate the nature of the present invention and the manner of practicing the same. The example demonstrates the benefits of the invention that were realized during an operation of the selective vaporization process conducted in a modification of existing commercial FCCU unit. To avoid a time delay and cost of a specially designed riser, only minor modifications were made to the existing riser with the understanding that contact time between contact material and feed would be longer than desired and that poorer yields would result. To achieve an acceptably low residence time, product gas was recycled to the riser. The riser was operated at lower pressure than unit design to help vaporize the feed. Riser steam was injected to reduce further the hydrocarbon partial pressure.

Feed of 22° API gravity was a synthetic resid obtained by blending vacuum gas oil with the asphalt. The contact material was composed of calcined clay in the form of fluidizable microspheres. Such microspheres are described in U.S. Pat. No. 4,263,128. Contactor temperature measured in the contactor dilute phase was about 945° F. Burner temperature measured in the dense phase was maintained as about 1400° F. by direct injection of cooling water when necessary.

During the operation of the unit, it was observed that coke and light gas yields began to exceed expectations. To maintain burner temperature at 1400° F., water was added at the rate of 10% by weight of the fresh feed. Analysis of the feedstock showed 158 ppm of chloride. The measured chloride content on the circulating inventory of contact material was 1200 ppm on the day ("day 0") before ammonia injection commenced. This corresponds to 5.43 moles Cl/day. It was calculated that if all of the chloride in the feed remained on the contact material, the chloride content of the contact material would increase by 7.20 moles/day. On the first day of the trial in which ammonia addition commenced, ammonia in the form of a 30% ammonium hydroxide solution was introduced with the feed at a rate calculated to be 6.24 moles $NH_3$/day. The ammonia injection was piped up to an existing drain (bleeder) valve on the feed line to the riser.

On the second day, as ammonium hydroxide injection with feed continued at the rate of 6.24 moles/day, additional ammonia was added in the form of ammonium polysulfide. The ammonium polysulfide was added to the base of the annular area surrounding the feed injection bayonet in the riser at a rate corresponding to 5.52 moles $NH_3$/day. On day three, ammonia injection to the feed was increased to 7.92 moles $NH_3$/day and 5.52 moles $NH_3$/day was added as ammonium polysulfide in the annulus. On day 4, feed rate of ammonia with feed was increased to 44.4 moles $NH_3$/day and ammonium polysulfide was added in the annulus in amount corresponding to 5.52 moles $NH_3$/day.

Assuming that all ammonia introduced reacted with chloride to form ammonium chloride, chloride contents of circulating contact material were calculated to range from 1200 ppm on day 0, 1411 ppm on day 1, 404 ppm on day 2, and 0 on days 3 and 4. Because of the difficulty involved in measuring chloride, the effect of ammonia addition was tracked indirectly by observations in the change in rate of adding cooling water which, in turn, was related to increases in coke production.

The effect of the ammonia injection in mitigating the effect of chloride contamination was evidenced by the fact that at day 4, the cooling water rate required to maintain the burner at 1400° F. was reduced to 3.9% (wt), based on the weight of fresh feed. Before ammonia injection, the cooling water addition rate was 10 wt%. Thus, the rate of addition of cooling water was reduced by about 61%. Hydrogen and dry gas yields were reduced without deleterious effect on yields or operating condition. Coke make was reduced by 8.9%. Data are summarized in table form below.

| | Day 0 Before Ammonia Injection | Day 4 After Ammonia Injection |
|---|---|---|
| SCFB $H_2$ | 222 | 208 |
| SCFB $C_2$− | 381 | 346 |
| Coke wt % | 7.9 | 7.2 |
| Vol. % 430° F. - Conversion | 22 | 22 |
| Contactor Temp. °F. | 945 | 948 |
| Burner Temp. °F. | 1400 | 1400 |
| Regen. cooling water wt % FF | 10 | 3.9 |

Calculations based on data in the table (and assuming the heat of combustion of coke yields 16,000 BTU/lb. coke and burner spray water was introduced at 100° F.) indicate that a decrease in coke yield of 0.7% (wt.) would result in a reduction in spray water rate of about 6.6%. This value approximates the measured reduction of 6.1%.

The calculations are as follows:

$$\left(\frac{16{,}000\ \text{BTU}}{16\ \text{coke}}\right)\left(\frac{16\ \text{coke}}{100\ \text{lb. feed}}\right) = \left(\frac{1750 - 68\ \text{BTU}}{\text{lb. spray water}}\right)\left(\frac{16\ \text{spray water}}{100\ \text{lb. feed}}\right)$$

$$9.51 = \frac{\text{wt \% spray water}}{\text{wt \% coke}}$$

Spray water = 10 − 3.9 = 6.1
(measured reduction in spray water)
Coke yield = 7.9 − 7.2 = 0.7
(measured reduction in coke yield)
(0.7) (9.51) = 6.6 = 6.1
(calculated reduction in spray water)

I claim:

1. A process for preparing premium products from a charge of petroleum hydrocarbon feedstock having a substantial Conradson Carbon number and metals content and which is contaminated with a halogen, wherein said halogen promotes undesirable cracking activity, which comprises contacting said feedstock in a decarbonizing and demetallizing zone with particles of a fluidizable solid contact material having a low microactivity for catalytic cracking at low severity, including a temperature of at least 900° F., for a period of time less than that which induces substantial thermal cracking of said feedstock; at the end of said period of time separating from said solid a decarbonized volatilized hydrocarbon fraction of reduced Conradson Carbon number and metals content as compared with said feedstock; reducing temperature of said separated fraction to a level below that at which substantial thermal cracking takes place; subjecting said particles of fluidizable inert solid after contact with said feedstock to air at elevated temperature in a separate burning zone to remove combustible deposit from said solid and heat the solid; recycling at least a portion of said particles of fluidizable solid from the burning zone to the decarbonizing zone for further decarbonizing and demetallizing of said feedstock; and, at least contacting at least a portion of said fluidizable solid particles so recycled to the decarbonizing zone particles with a volatile basic nitrogen compound or a compound thermally decomposable thereto in said contactor either prior to or simultaneously while contacting said particles with said feedstock in said decarbonizing zone wherein said halogen contaminant is reacted with said nitrogen basic compound to form a volatile material.

2. The process of claim 1 wherein the source of said halogen is sodium chloride.

3. The process of claim 1 wherein the source of said halogen is ethylene chloride.

4. The process of claim 1 wherein said volatile basic nitrogen compound comprises ammonia.

5. The process of claim 1 wherein said volatile basic nitrogen compound comprises ammonium polysulfide.

6. The process of claim 1 wherein said volatile basic compound comprises the combination of ammonia added as ammonium hydroxide solution and ammonium polysulfide.

7. The process of claim 1 wherein said source of ammonia is added when coke production exceeds substantially the amount of coke that would be expected based on the Conradson Carbon residue of feedstock and metals level of said contact material.

8. The process of claim 1 wherein feedstock is contaminated with sodium chloride and said ammonia or a thermally decomposable source thereof is added in amount at least stoichiometric to react with chloride in feedstock.

9. A process for preparing premium products from petroleum having a substantial content of Conradson Carbon and metals content and which is contaminated with a halogen wherein said halogen promotes undesirable cracking activity, which comprises (a) contacting said petroleum hydrocarbon feedstock in a riser with fluidizable particles which are catalytically inert or substantially so for a contact time and a temperature of at least 900° F. such as to avoid substantial thermal cracking of said feedstock and selectively vaporize hydrocarbons and deposit hydrocarbons contributing to Conradson Carbon number as well as metals and halogen on said fluidizable particles; (b) at the end of said period of time separating from said particles of inert material now having a deposit of hydrocarbon, metals and halogen from a vaporized decarbonized hydrocarbon fraction of reduced Conradson Carbon number as compared with said residual fraction; (c) reducing temperature of the separated hydrocarbon fraction to a level below that at which substantial thermal cracking takes place; (d) displacing hydrocarbon from said particles with steam; (e) fractionating said vaporized hydrocarbon fraction from step (b) to separate at least one lighter hydrocarbon fraction and adding water to at least a portion of said separated lighter hydrocarbon fraction; (f) separating liquid water from lighter hydrocarbon from step (e); (g) burning combustibles from said particles of said inert material to remove said combustible deposit and thereby heat the inert solid; (h) separating hot gases from the burning of combustibles from hot inert solids in said burner; (i) recycling at least a portion of said hot inert solids into contact with further charge of said hydrocarbon feedstock; (j) injecting ammonia or a source of ammonia into said recycled hot solids prior to step (i) in amount corresponding to at least the equivalent amount of halogen in the said further charge of said hydrocarbon feedstock; (k) reacting ammonia with halogen in said contacting zone, whereby a volatile material containing ammonia and halide is carried into the vaporized hydrocarbon fractions in step (b) and enters in the liquid water that is separated from light hydrocarbon fraction in step (f).

10. The process of claim 9 wherein the source of said halogen is sodium chloride.

11. The process of claim 9 wherein the source of said halogen is ethylene chloride.

12. The process of claim 9 wherein said volatile basic nitrogen compound comprises ammonia.

13. The process of claim 9 wherein said volatile basic nitrogen compound comprises ammonium polysulfide.

14. The process of claim 9 wherein said volatile basic compound comprises ammonia added as ammonium hydroxide solution and ammonium polysulfide.

15. The process of claim 9 wherein said lighter fraction comprises gas and naphtha.

16. The process of claim 9 wherein feedstock is contaminated with sodium chloride and said ammonia or a thermally decomposable source thereof is added in amount at least stoichiometric to the amount needed to react with all chloride in feedstock.

17. The process of claim 9 wherein feedstock is contaminated with sodium chloride and said ammonia or a thermally decomposable source thereof is added in amount at least twice the stoichiometric amount needed to react with all chloride in feedstock.

* * * * *